United States Patent [19]

Bresan

[11] 4,291,482

[45] Sep. 29, 1981

[54] STABILIZING ATTACHMENT FOR HAND GUN

[76] Inventor: Joseph R. Bresan, 207 Baywood Dr., Fishing Creek, Cape May, N.J. 08204

[21] Appl. No.: 96,634

[22] Filed: Nov. 23, 1979

[51] Int. Cl.[3] ..... F41C 23/00

[52] U.S. Cl. ..... 42/72

[58] Field of Search ..... 42/72, 73, 71 P

[56] References Cited

U.S. PATENT DOCUMENTS

| | | | |
|---|---|---|---|
| 202,946 | 4/1878 | Johnson | 42/72 |
| 562,487 | 6/1896 | Quackenbush | 42/72 |
| 1,027,556 | 5/1912 | Marshall | 42/72 |
| 2,424,194 | 7/1947 | Sampson et al. | 42/72 |
| 3,162,966 | 12/1964 | La Coss | 42/72 |
| 3,184,877 | 5/1965 | Andrews | 42/72 |
| 3,570,162 | 3/1971 | Suddarth | 42/72 |
| 3,648,396 | 3/1972 | Smith | 42/72 |
| 3,782,019 | 1/1974 | Venturini | 42/72 |

*Primary Examiner*—Charles T. Jordan

*Attorney, Agent, or Firm*—Thomas A. Lennox

[57] ABSTRACT

A stabilizing attachment for firearms is provided to support the forearm during firing and includes two rods through horizontal holes in a vertical extension of the grip with the rods extending to the rear connected to an upright "U" shaped support for the forearm and a hand released securing mechanism to hold the horizontal rods in an adjustable position.

11 Claims, 4 Drawing Figures

STABILIZING ATTACHMENT FOR HAND GUN

BACKGROUND OF THE INVENTION

This invention relates to firearms including automatic pistols, revolvers, bolt-action firearms, semi-automatic firearms, pistols, rifles, machine guns and the like. For purposes of this specification, the term "firearm" includes all devices which are capable of ejecting a projectile when the person operates a release mechanism while holding the device in the hand or hands. More particularly, the invention is directed to a hand gun such as an automatic pistol or a revolver held at arms length or for a rifle without a full stock which is to be rested against the shoulder and held with two hands.

It has long been recognized that the accuracy of firing a firearm is limited by the person's ability to hold his hand and wrist in a steady position while aiming the hand gun. This invention relates not only to the need for support of the forearm when the firearm is held at arm's length in the firing position, but also to the need for adjustment of the angle of the support depending upon the circumstances of the firing. The invention also relates to providing the versatility of using a support either on the forearm or on the shoulder such as the position in which a rifle is normally fired.

A number of devices have been described including the stabilizing attachment attached to the butt end of the hand grip with a brace to the top of the forearm of the hand, in U.S. Pat. No. 3,648,396, to Roger A. Smith. In U.S. Pat. No. 3,162,966, to G. M. LaCoss, a hand stabilizer again connected to the butt end of the hand gun is described. W. G. Andrews in his U.S. Pat. No. 3,184,877, describes a non-adjustable pistol stabilizer again extending from the butt of the pistol over the top of the forearm. A forearm support again attached to the butt end of a pistol is described in U.S. Pat. No. 1,027,557 to Marshall. Folding stocks for firearms are described in U.S. Pat. No. 961,511 to W. L. Marble, U.S. Pat. No. 3,570,162 to J. Suddarth and U.S. Pat. No. 3,782,019 to G. Venturini. The Marble stock extends from the butt of the firearm while the other two extend from the trigger guard area. None of these devices meets the needs described above nor the objects below.

It is an object of this invention to provide a detachable forearm support device for a firearm which may be constructed of rigid and not easily deformed material but yet be adjustable to fit the forearm shape and size depending upon the clothing worn and the special circumstances of the use.

It is an additional object of this invention to provide a forearm support for a firearm which does not interfere with holding the butt end of the firearm.

It is a further object of this invention to provide a forearm support for a firearm that is simply constructed without any unnecessary members.

It is an additional object of this invention to provide a support that is light in weight, but yet provides rigid support to the forearm with rotational adjustment capabilities.

It is an additional object of this invention to provide a multi-purpose extension device which will fit directly on the handgrip of a firearm that receives and holds the forearm support but offers additional capabilities for attachment of auxiliary equipment to the forearm.

It is a particular object of this invention to provide a forearm support which, although chosen to fit the owner of the firearm, it will be adjustable rotationally and longitudinally to compensate for differences in the owner's clothing he is wearing on his arm and the particular circumstances for the firing of the firearm.

A particular object of this invention is to provide means for releasably securing the forearm support which may be adjusted rotationally and longitudinally by use of the free hand while the firearm is held in the firing position.

It is an additional object of this invention to provide a forearm support which may be extended and used as a shoulder support providing greater versatility and the possibility of greater accuracy when firing the firearm.

It is an additional object of this invention that the stock may be reversable and utilized as a forward grip.

It is a particular object of this invention that an extension support for the forearm support include the capability of attaching a scope or shell casing catcher to the handle in such a way as to not interfere with the operation of the firearm.

SUMMARY OF THE INVENTION

My invention is used on a firearm as held in firing position with the butt having two lateral sides with hand grips including one grip shaped to fit the hand for holding and aiming the firearm. The butt, for the purposes of this specification, is that portion of the firearm which is gripped by the hand that is also pressing the release mechanism for firing, generally known as the trigger. The invention is a stabilizing attachment including a vertical extension of the grip extending from the top of the grip preferably to a position at or above the top of the firearm. At least two horizontal apertures, preferably two, extend from the back into the extension. These apertures are preferably round and extend entirely through the extension, front to back. It is preferred that these holes are set apart vertically a sufficient distance to provide rigidity between rods inserted in the holes, but also close enough to allow rotational adjustment of the rods, even when they are rigidly interconnected. Two horizontal members are slidably fitted in the apertures, the rods being of sufficient length to reach from the vertical extension to the forearm of the person holding the firearm. An upright "U" shaped support means is rigidly connected to the rear end of the two horizontal members of a shape to cup and support the forearm from below. A securing mechanism, which may be released by hand, for securing and holding the horizontal members in the apertures both as to longitudinal sliding and rotational movement.

It is preferred that the support meams be rear down-turned extremities of the rods each down-turn spaced laterally front to back from the rear of the firearm with a structural continuation in the shape of upright "U" extremities one for each member from the down-turn, each "U" shape spaced laterally and adjacent front to back from the firearm to form a cradle for the person's forearm and finally an upwardly arcuate member connecting the exposed ends of the "U" shapes to form a rigid structure. The preferred overall length of the stabilizing attachment extends at least from the vertical extension of the grip to the forearm of the person holding the firearm in the firing position. It is preferred to provide a multipurpose attachment means on the top of the vertical extension which allows an attachment to the firearm of various auxiliary equipment, such as a scope, shell catcher and the like.

DESCRIPTION OF PREFERRED EMBODIMENTS

Figure 1:
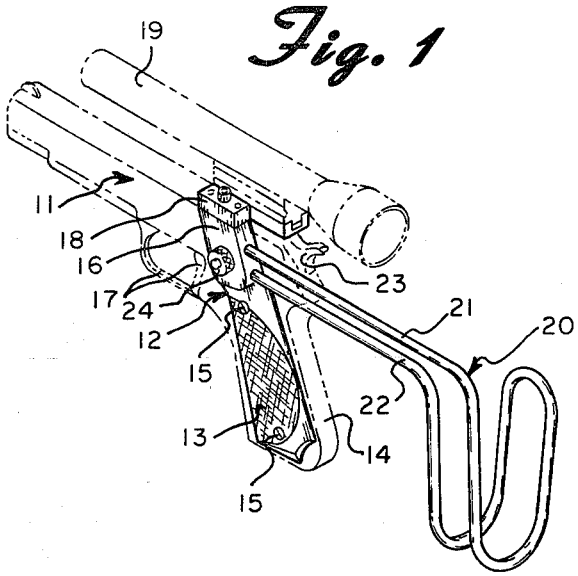
FIG. 1 is a perspective view of a revolver with the stabilizing attachment of this invention shown in place together with a shadow view of a scope shown in place.
Figure 2:
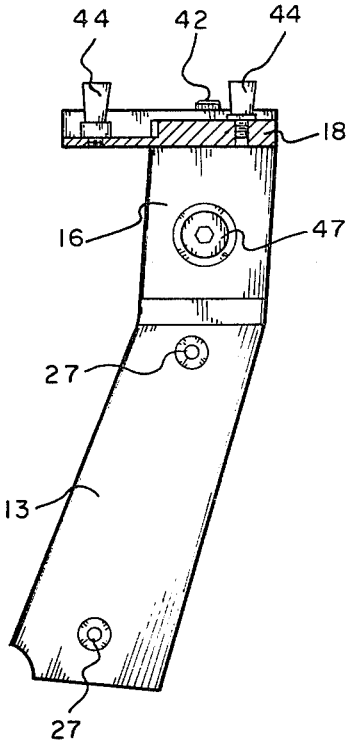
FIG. 2 is a side view of the grip, the extension and a partial cross-section of the multi-purpose attachment plate.

In FIG. 1, the firearm support and auxiliary equipment attachment system device 10 as shown in the exploded perspective view of FIG. 2 is shown connected hand gun 11. Modified grip plate, extension and attachment system 12 is attached by flat head screw bolts 15 threaded onto firearm base grip plate 14 in the normal fashion. Grip 13 fits the hand and is essentially identical to the grip plate on the hidden side of the revolver, both together shaped to fit the hand. Vertical extension 16 is a molded extension onto grip 13 formed of a thermoset, reinforced plastic material phenolic resin, melamine or other synthetic resin, or may be formed of a hard wood or metal. Vertical extension 16 of grip 13 extends upwardly and is well away from and not in the way of trigger and guard 17. Mounting bracket 18 for auxiliary attachments such as a scope 19 or a shell catcher is connected directly on top of vertical extension 16. Forearm and shoulder support system 20 includes upper horizontal member 21 and lower horizontal member 22 both extending from the rear into vertical extension 16 and held in position by adjustment release and securing knob 24. System 20 is well away from and does not interfere with hammer 23.

In FIG. 2, grip plate extension and attachment system 12 is shown separated from hand gun 11 normally attached through holes 27 in grip plate 13. Upper horizontal one-quarter inch hole 28 and lower horizontal one-quarter inch hole 29 extend through vertical extension 26, and open to the front of pistol 11. Horizontal one-quarter inch steel rods 21 and 22 extend parallel to each other from the rear of vertical extension 16 with longer end 30 on rod 21. Rod 21 down-turns after extension 30 and continues in vertically downwardly extending member 31, into upward arcuate turning member 32 and then to upwardly vertical extending member 33, these three members forming a rear upright "U" shaped member transverse to the rear of pistol 11 and forming a plane which may be rested against the shoulder of the person holding the hand gun in firing position. Rod 22 turns downwardly and continues as downwardly vertical extending member 34, continues to upward arcuate turning member 35 and continues to upwardly vertical extending member 36, again forming a frontal upright "U" shaped member transverse to the pistol. Upwardly arching arcuate connecting member 37 joins vertical members 33 and 36 to form a rigid structure. The entire forearm and shoulder support following from member 21 and continuing throughout the body to member 22 is formed on a one-quarter inch diameter spring steel rod. Constructed in this fashion, it cannot be easily deformed except with tools. On top 39 of extension 16 are holes 40 which receive downwardly distending pins which extend through bracket 18 but are hidden from view in FIG. 2. Bolt 42 extends through bracket 18 and is threadably connected into hole 43. Upright standard quick connect mount pin 44 extends from bracket 18 for mounting scope and or shell catcher on top of bracket 18.

Figure 3:
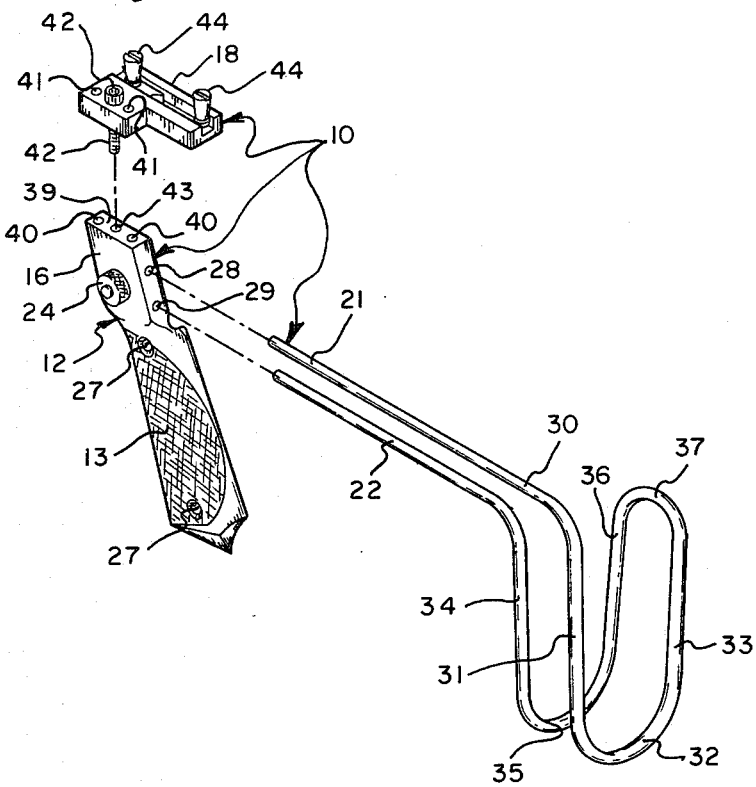
FIG. 3 is an exploded perspective view of the grip with extension, the stabilizing attachment and the multi-purpose attachment plate.

In FIG. 3, the side view of grip 13 with extension 16 and additional detail with a partial cross-sectional view of bracket 18. Quick connect mount pins 44 are shown as threadably connected to bracket 18 which is held in position on the top of extension 16 with bolt 42.

Figure 4:
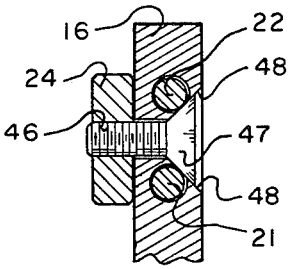
FIG. 4 is a partial cross-section of the grip plate showing the release and securing system for the support.

In FIG. 4, a partial cross-sectional view shows the internal construction of the release and securing system controlled by knob 24. Knob 24 is threaded onto bolt 47 with tapered head 48 counter sunk in the wood or plastic of extension 16. When knob 24 is hand tightened tapered head 48 is drawn against rod members 21 and 22 securing support system 20 in place. Loosening knob 24 allows support 20 to be easily adjusted rotationally and longitudinally. The distance between holes 28 and 29 of about three-quarters of an inch, preferably about three-eighths of an inch to about one and one-half inches, allows the combination of rotational adjustment and rigidity.

By releasing knob 24 support 20 may be adjusted to varying lengths merely by pushing rods 21 and 22 through holes 28 and 29 and re-tightening knob 24 at the desired length. In addition, despite the fact that holes 28 and 29 are spaced apart approximately three quarters of an inch support 20 may be rotated in either direction up to at least 20 degrees in order to provide adjustment for comfortable support in the forearm and fine adjustment depending upon the circumstances. It is particularly effective to hold pistol 11 in the firing position with knob 24 loosened. When support 20 is in position and is comfortable, knob 24 may be tightened in place with the left hand and without the necessity of loosening the grip with the firing hand.

While my invention is described with particularity as to material, shape and size, it should be understood that the specifics are not critical to this invention. The patent is intended to include modification and changes which may come within and extend from the following claims.

I claim:

1. On a firearm, as held in the firing position with a butt having two lateral sides with handgrips comprising the combined grips shaped to fit the hand for holding and aiming the firearm, a stabilizing attachment comprising:

(a) a vertical extension of one of the grips, extending from the top of the grip, (b) at least two horizontal apertures extending front to back through the vertical extension, (c) two horizontal members slidably fitting in the apertures of sufficient length to reach from the vertical extension to the forearm of the person holding the firearm, (d) an upright "U" shaped support means rigidly connected to the rear extremity of the two horizontal members of a shape to cup and support the forearm from below, and (e) a securing means for hand releasably securing and holding the horizontal members in the apertures both as to longitudinal sliding and rotational movement.

2. The firearm stabilizing attachment of claim 1 wherein the horizontal members are circular in cross-section and the holes are also circular being spacably set apart a distance to provide rigidity but also allow rotational adjustment of the support means.

3. The firearm stabilizing attachment of claim 1 wherein the stabilizing attachment comprises:

(a) horizontal rods slidably fitting in the apertures, the rods and apertures being alignably spaced apart vertically, (b) rear down-turned extremities of the rods, each down-turned spaced laterally front to back from the rear of the firearm, (c) upright "U" shaped extremities of each member from the down-turn, each "U" shape spaced laterally and adjacent front to back from the firearm to form a cradle for the person's forearm, and (d) an upwardly arcuate member connecting portion of the members joining the ends of the extremities, wherein the overall length of the stabilizing attachment extends at least from the vertical extension of the grip to the forearm of the person holding the firearm in the firing position.

4. The firearm stabilizing attachment of claim 3 wherein the front extremities of the rods are circular in cross-section with the apertures shaped to receive those extremities and being spacedly set apart a distance to provide rigidity but also allow rotational adjustment of the stabilizing attachment.

5. The firearm stabilizing attachment of claim 1 wherein the firearm is a hand gun.

6. The firearm stabilizing attachment of claim 1 wherein the vertical extension of the grip extends to or above the top of the firearm.

7. The firearm stabilizing attachment of claim 1 wherein a multi-purpose attachment means is provided on top of the vertical extension of the grip allowing attachment to at least a scope, a shell catcher or other auxillary device.

8. A firearm stabilizing attachment of claim 1 wherein the horizontal apertures extend entirely through the vertical extension of the grip.

9. The firearm stabilizing attachment of claim 1 wherein the horizontal members and the support means is constructed of circular rigid rod stock.

10. On a firearm, as held in the firing position with a butt having two lateral sides with handgrips comprising the combined grips shaped to fit the hand for holding and aiming the firearm, a stabilizing attachment comprising:

(a) vertical extension of the grip, extending from the top of the grip, (b) at least two horizontal round apertures extending front to back through the vertical extension, (c) two horizontal members with a round cross-section slidably fitting in the apertures of sufficient length to reach from the vertical extension to the forearm of the person holding the firearm, (d) an upright "U" shaped support means rigidly connected to the rear extremity of the two horizontal members of a shape to cup and support the forearm from below, and (e) a securing means for hand releasably securing and holding the horizontal members in the apertures both as to longitudinal sliding and rotational movement.

wherein the apertures are spacably set apart a distance to provide rigidity of the support means when the securing means is tight but also allow rotational adjustment of the support means when the securing means is loosened.

11. The stabilizing attachment of claim 10 wherein the round apertures are vertically spaced apart a distance in the range of three-eights inch to one and one-half inches.

* * * * *